US010301093B2

(12) United States Patent
Steele

(10) Patent No.: US 10,301,093 B2
(45) Date of Patent: May 28, 2019

(54) PACKAGE VALVE CLOSURE SYSTEM AND METHOD

(71) Applicant: ILLINOIS TOOL WORKS INC., Glenview, IL (US)

(72) Inventor: Mark Steele, New Prague, MN (US)

( * ) Notice: Subject to any disclaimer, the term of this patent is extended or adjusted under 35 U.S.C. 154(b) by 0 days.

(21) Appl. No.: 15/972,696

(22) Filed: May 7, 2018

(65) Prior Publication Data

US 2018/0251282 A1 Sep. 6, 2018

Related U.S. Application Data

(63) Continuation of application No. 15/145,587, filed on May 3, 2016, now Pat. No. 9,963,284, which is a continuation of application No. PCT/US2016/024382, filed on Mar. 26, 2016.

(60) Provisional application No. 62/145,484, filed on Apr. 9, 2015.

(51) Int. Cl.

| | |
|---|---|
| ***B65D 33/01*** | (2006.01) |
| ***B65D 75/00*** | (2006.01) |
| ***B65D 75/58*** | (2006.01) |
| ***B65D 33/16*** | (2006.01) |
| ***B65D 47/20*** | (2006.01) |

(52) U.S. Cl.

CPC ..... *B65D 75/008* (2013.01); *B65D 33/01* (2013.01); *B65D 33/16* (2013.01); *B65D 47/2031* (2013.01); *B65D 75/5866* (2013.01)

(58) Field of Classification Search

CPC .. B65D 75/008; B65D 33/01; B65D 75/5866; B65D 33/16

See application file for complete search history.

(56) References Cited

U.S. PATENT DOCUMENTS

| | | | |
|---|---|---|---|
| 2,460,853 | A | 2/1949 | Siple |
| 2,715,759 | A | 8/1955 | Poux |
| 2,720,903 | A | 10/1955 | Pickren |
| 2,785,824 | A | 3/1957 | Reeves |
| 2,994,117 | A | 8/1961 | McMullin |
| 3,025,629 | A | 3/1962 | Sears |
| 3,058,187 | A | 10/1962 | Gugen |
| 3,102,570 | A | 9/1963 | Fairchilds |
| 3,133,575 | A | 5/1964 | Slemmons |
| 3,151,650 | A | 10/1964 | Beck |
| 3,224,640 | A | 12/1965 | Schneider et al. |
| 3,339,721 | A | 9/1967 | Goldstein |

(Continued)

FOREIGN PATENT DOCUMENTS

| | | |
|---|---|---|
| CN | 1717258 | 1/2006 |
| CN | 101990514 | 3/2011 |

(Continued)

OTHER PUBLICATIONS

The International Search Report and the Written Opinion rendered by the International Searching Authority for PCT/US16/24382, dated Jun. 30, 2016, 13 pages.

*Primary Examiner* — Donnell A Long
(74) *Attorney, Agent, or Firm* — McCarter & English, LLP

(57) ABSTRACT

A package is disclosed. The package includes at least one valve or closure device provided at an access opening of the package. A method of forming and dispensing contents from a flexible package is also disclosed. Seals can be selectively applied to seal the closure to the package, control pressure in the closure, and to define a product flow pathway to facilitate dispensing of product upon sufficient pressure by the user.

11 Claims, 7 Drawing Sheets

(56) References Cited

U.S. PATENT DOCUMENTS

| | | | |
|---|---|---|---|
| 3,343,233 | A | 9/1967 | Gould |
| 3,367,380 | A | 2/1968 | Dickey |
| 3,390,507 | A | 7/1968 | Repko |
| 3,542,032 | A | 11/1970 | Spencer et al. |
| 3,874,115 | A | 4/1975 | London et al. |
| 4,155,453 | A | 5/1979 | Ono |
| 4,209,115 | A | 6/1980 | Stahl |
| 4,313,609 | A | 2/1982 | Clements |
| 4,519,499 | A | 5/1985 | Stone et al. |
| 4,588,554 | A | 5/1986 | Kaartinen et al. |
| 4,703,518 | A | 10/1987 | Ausnit |
| 4,806,021 | A | 2/1989 | Koudstaal et al. |
| 4,874,093 | A | 10/1989 | Pharo |
| 4,877,334 | A | 10/1989 | Cope |
| 4,913,561 | A | 4/1990 | Beer |
| 4,923,701 | A | 5/1990 | VanErden |
| 5,050,736 | A | 9/1991 | Griesbach et al. |
| 5,080,248 | A | 1/1992 | Stocchiero |
| 5,120,553 | A | 6/1992 | Kupcikevicius |
| 5,209,347 | A | 5/1993 | Fabisiewicz et al. |
| 5,335,478 | A | 8/1994 | Aronsen |
| 5,447,235 | A | 9/1995 | Pharo |
| 5,465,833 | A | 11/1995 | Tarter |
| 5,535,888 | A | 7/1996 | De Luca |
| 5,558,438 | A | 9/1996 | Warr |
| 5,692,837 | A | 12/1997 | Beer |
| 5,743,443 | A | 4/1998 | Hins |
| 5,803,256 | A | 9/1998 | Lydhig et al. |
| 5,882,117 | A | 3/1999 | Laffon |
| 5,928,213 | A | 7/1999 | Barney et al. |
| 5,971,613 | A | 10/1999 | Bell |
| 6,020,013 | A | 2/2000 | Kozma |
| 6,036,004 | A | 3/2000 | Bowen |
| 6,053,635 | A | 4/2000 | Anderson et al. |
| 6,065,873 | A | 5/2000 | Fowler et al. |
| 6,164,822 | A | 12/2000 | Beer |
| 6,186,663 | B1 | 2/2001 | Ausnit |
| 6,193,416 | B1 | 2/2001 | Kawamata et al. |
| 6,203,535 | B1 | 3/2001 | Barney et al. |
| 6,245,367 | B1 | 6/2001 | Galomb |
| 6,352,365 | B1 | 3/2002 | Healy et al. |
| 6,375,037 | B1 | 4/2002 | Bell et al. |
| 6,376,035 | B1 | 4/2002 | Dobreski et al. |
| 6,481,183 | B1 | 11/2002 | Schmidt |
| D468,195 | S | 1/2003 | Bell |
| 6,533,711 | B1 | 3/2003 | Anderson et al. |
| 6,572,267 | B1 | 6/2003 | Forman |
| 6,616,333 | B2 | 9/2003 | Kinigakis et al. |
| 6,629,777 | B2 | 10/2003 | Tanaka et al. |
| 6,641,307 | B2 | 11/2003 | Matsuda et al. |
| 6,655,837 | B2 | 12/2003 | Matsuda et al. |
| 6,726,364 | B2 | 4/2004 | Perell et al. |
| 6,789,945 | B2 | 9/2004 | Mobs et al. |
| 6,854,886 | B2 | 2/2005 | Piechocki et al. |
| 6,899,239 | B1 | 5/2005 | Gray |
| 6,910,995 | B2 | 6/2005 | Schneider et al. |
| 6,938,394 | B2 | 9/2005 | Perell |
| 6,968,952 | B2 | 11/2005 | Crevier et al. |
| 7,040,810 | B2 | 5/2006 | Steele |
| 7,048,442 | B2 | 5/2006 | Schneider et al. |
| 7,207,717 | B2 | 4/2007 | Steele |
| D549,594 | S | 8/2007 | Steele |
| 7,340,807 | B2 | 3/2008 | Dais et al. |
| 7,883,268 | B2 | 2/2011 | Steele |
| 8,613,547 | B2 | 12/2013 | Steele |
| 9,694,965 | B2 | 7/2017 | Cox et al. |
| 2001/0030134 | A1 | 10/2001 | Goglio et al. |
| 2002/0154835 | A1 | 10/2002 | Galomb |
| 2003/0147565 | A1 | 8/2003 | Plourde et al. |
| 2003/0189062 | A1 | 10/2003 | Credle, Jr. |
| 2003/0219174 | A1 | 11/2003 | Piechocki |
| 2004/0031244 | A1 | 2/2004 | Steele |
| 2004/0045854 | A1 | 3/2004 | Bergerioux et al. |
| 2004/0057638 | A1 | 3/2004 | Perell et al. |
| 2004/0231292 | A1 | 11/2004 | Perell |
| 2005/0069227 | A1 | 3/2005 | Steele |
| 2005/0139603 | A1 | 6/2005 | Lee |
| 2006/0052738 | A1 | 3/2006 | Ramella |
| 2006/0126970 | A1 | 6/2006 | Perell |
| 2006/0215942 | A1 | 9/2006 | Steele |
| 2007/0189641 | A1 | 8/2007 | Steele |
| 2007/0278114 | A1 | 12/2007 | Kane et al. |
| 2008/0002918 | A1 | 1/2008 | Steele |
| 2008/0223875 | A1 | 9/2008 | LaFlamme et al. |
| 2008/0286420 | A1 | 11/2008 | Domingues et al. |
| 2009/0071977 | A1 | 3/2009 | Abe |
| 2009/0180716 | A1 | 7/2009 | Steele |
| 2009/0208147 | A1 | 8/2009 | Steele |
| 2009/0238499 | A1 | 9/2009 | Steele |
| 2009/0245699 | A1 | 10/2009 | Steele |
| 2009/0277916 | A1 | 11/2009 | Steele |
| 2011/0042407 | A1 | 2/2011 | Steele |
| 2014/0155240 | A1 | 6/2014 | Steele |

FOREIGN PATENT DOCUMENTS

| | | | |
|---|---|---|---|
| CN | 101391671 | | 6/2012 |
| EP | 0213673 | A1 | 3/1987 |
| EP | 0213673 | B1 | 7/1989 |
| EP | 2364922 | A2 | 9/2011 |
| EP | 2364922 | A3 | 1/2012 |
| JP | 2005022760 | A | 1/2005 |
| WO | 9824702 | A1 | 6/1998 |
| WO | 0151367 | A1 | 7/2001 |
| WO | 2005123196 | A2 | 12/2005 |
| WO | 2006052800 | A2 | 5/2006 |
| WO | 2008137937 | A1 | 11/2008 |

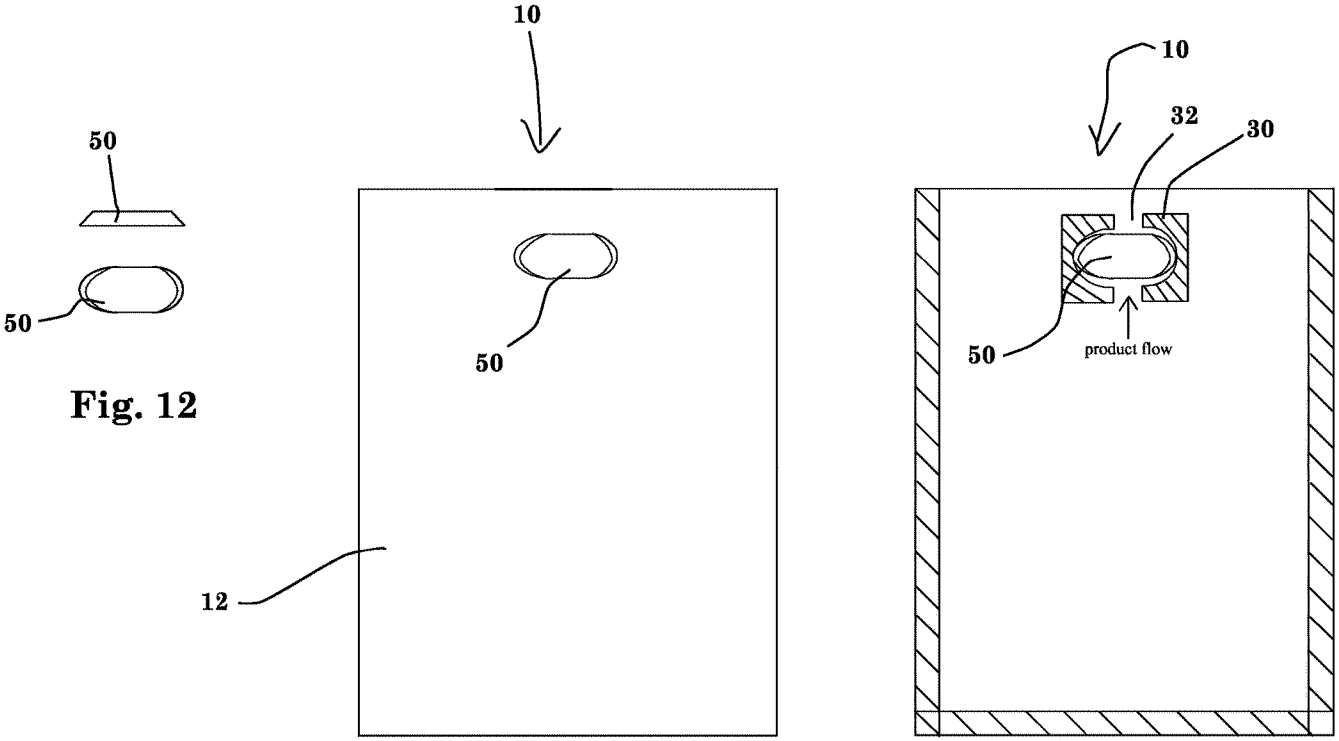
Fig. 12
Fig. 13
Fig. 14
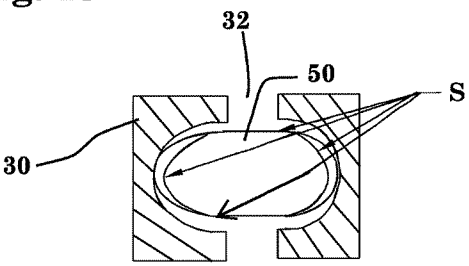
Fig. 15

PACKAGE VALVE CLOSURE SYSTEM AND METHOD

PRIORITY

This application is a Continuation Application of U.S. patent application Ser. No. 15/145,587, filed on May 3, 2016, which is a continuation application of PCT patent application Ser. No. PCT/US16/24382, filed on Mar. 26, 2016, which claims priority to and the benefit of U.S. Provisional Patent Application No. 62/145,484 filed Apr. 9, 2015, with each of the referenced applications being fully incorporated herein by reference.

FIELD

The present invention relates generally to flexible packaging and, more particularly, to packages, and methods for manufacturing and using packages, having sealed valve closure devices.

BACKGROUND

Conventional flexible packaging used for containing liquids are typically either a one-time use package or include the addition of a fitment with a screw or snap cap for multiple use products. Single use packages are less expensive, however, all of the product must be used or transferred to another container once the package has been opened because there is no means of sealing the package shut again. While multi-use packages that include a fitment or other closure mechanism are beneficial because not all the product has to be used or transferred into another container once they are initially opened, they can be very expensive (e.g., manufacturing and material costs) and they require two hands to manipulate.

Some packages use a leak resistant or leak proof zippers for reclosing a package. Various designs of the zipper and press-to-close mechanisms are suitable for maintaining a water or liquid tight seal. However, the interlocking members of both the zipper and the press-to-close closure mechanisms may also allow for fluid leakage and they may undergo plastic deformation after repeated use that adversely affects the ability of the mechanism to properly seal fluids within the package. Moreover, the zipper and press-to-close mechanisms may not be suitable for a gas tight seal. Accordingly, the contents of the package are susceptible to oxidation and other air-borne problems, such as the release of odors.

As a result, there is a need for a flexible package that substantially solves the above referenced problems with conventional package designs, configurations, and manufacturing methods.

SUMMARY

The present invention solves many of the problems identified above by providing a package, and package formation method, including a valve-type closure or sealing device. In one embodiment a flexible package is provided for holding contents, such as solids or fluids. The flexible package can include a flexible body defining an inner cavity and a dispensing portion (e.g., throat portion or non-tapered portion). A protruding closure (e.g., such as a generally bubble-shaped or like closure) disposed in or at a dispensing portion can be configured to provide selective release of the internal contents of the package upon sufficient pressure application on a portion of the package by the user.

Another embodiment is directed to a method of dispensing fluid from a flexible package. The method includes squeezing a body portion of a flexible package to force fluid contents in an inner cavity of the flexible package through the protruding valve closure provided to a portion of the body.

Yet another embodiment is directed to a method of forming a flexible package. The method includes providing the protruding closure to the package. Once the valve piece is affixed to a panel, the opposing panel can be placed over, or onto, the panel with the valve piece and the bracket seals applied by heat bonding or other methods known to one skilled in the art. If using an air bubble as the valve piece, where the amount of pressure required for different viscosities of products can be altered, the bracket seals can be adjusted in and out on each end of the bubble to increase or decrease the level of pressure and overall construct of the bubble.

Other embodiments are directed to a method of forming a flexible package, wherein the valve closure interfaces with a separate film layer draped over the protruding closure portion, rather than the opposing package panel portion, to permit and selectively restrict fluid flow past the valve device.

The above summary is not intended to describe each illustrated embodiment, claimed embodiment or implementation of the invention. The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The invention may be more completely understood in consideration of the following detailed description of various embodiments of the invention in connection with the accompanying drawings, in which:

FIG. 12 shows a side and top view of a rigid or semi-rigid material for use as a valve/closure device, in accordance with embodiments of the present invention.

FIGS. 13-15 show the rigid or semi-rigid material of FIG. 12 used as a valve/closure device, and the corresponding package, in accordance with embodiments of the present invention.

Figure 1:
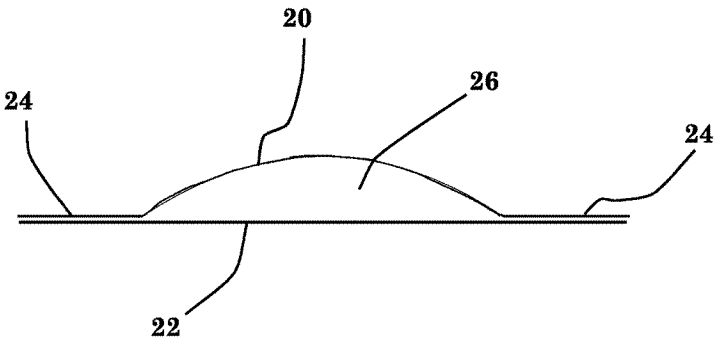
FIGS. 1-4 show a pre-formed bubble valve/closure patch, in accordance with embodiments of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, hatching or shading in the figures is generally provided to demonstrate sealed or crushed portions and/or integrated devices for the package.

DETAILED DESCRIPTION OF THE INVENTION

Referring generally to FIGS. 1-31, a flexible package 10 in accordance with the present invention is shown. The package 10 generally includes a front panel portion 12 and a back panel portion 14. Further, a bottom panel portion 15, gusseted or non-gusseted, can be included, especially in those embodiments defining a stand up package. The joining and/or shaping of the panels 12, 14, 15, generally define an inner cavity 21 having an adjustable internal volumetric capacity. The inner cavity 21 is capable of storing, transporting and/or dispensing product or other objects and material therein. Side panel portions, gusseted or non-gusseted, may also be included. The panel portions are often referred to as webs, films or layers.

References to "top," "bottom," "front," "side," "back" and the like are for illustrative purposes only and are not meant to limit the scope of the disclosed invention.

The package according to the invention can include packages constructed, in whole or in part, of flexible, rigid, semi-rigid, or semi-flexible materials or panels. Briefly, the package panel portions can be constructed of flexible sheet material such as polyethylene, polyester, metal foil, polypropylene, or polyethylenes or polypropylenes laminated with other materials such as nylon, polyester, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The present invention in certain embodiments permits the flexible package to be made using less expensive or cheaper materials than would otherwise be necessary.

In one embodiment, the front panel portion 12 and the back panel portion 14 will be formed of one contiguous web material. In alternative embodiments, at least one of the panel portions can be distinct web materials joined or sealed to other respective panel portions to form the package 10 of the present invention. For instance, the front panel portion 12 and the back panel portion 14 can be joined to each other from distinct non-contiguous web sheets of material, and one of the panel portions 12-14 can further extend to define the bottom panel portion 15. The bottom panel portion 15 in the various configurations forming a stand up pouch can include a gusset known to those skilled in the art to further promote operative expansion and contraction of the package 10 and its respective capacity in accordance with the receipt and removal of material within the package 10.

Various embodiments of the systems, device, features and methods detailed herein are envisioned for use with, and can incorporate aspects of, many known packages, systems, and methods, including those disclosed in U.S. Pat. Nos. 8,613,547 and 7,883,268. Accordingly, the above-identified patent disclosures are fully incorporated herein by reference in their entirety.

Figure 2:
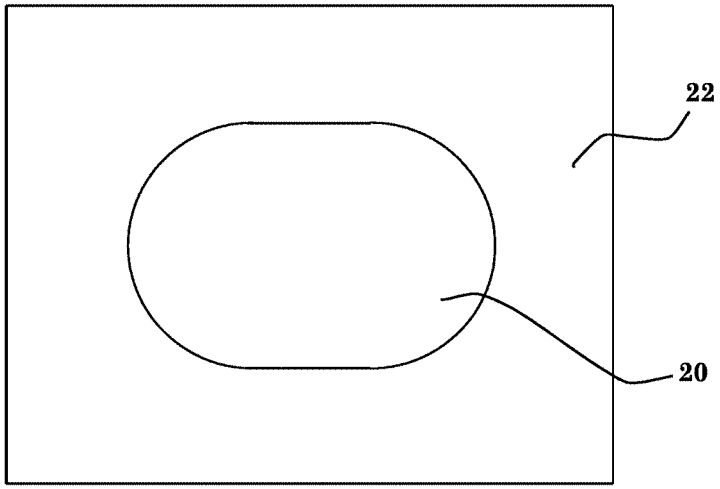
Figure 3:
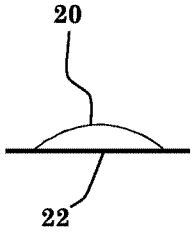
Figure 4:
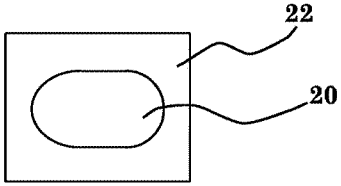

Referring to FIGS. 1-2, packages 10 of the present invention can include one or more valve closures 20, including a bubble-shaped closure, hollow or sold protrusions, extending members, convex-shaped features, or any like structure or feature having a shape and size to provide selective blocking of an access opening. Upon application of pressure by the end user, product from within the inner cavity 21 can be forced out past the closure 20, while remaining within the inner cavity until such pressure is applied (even with movement, tipping, or placing of the package 10 completely upside down).

The device 20 can be applied to a patch of material 22, with end portions 24 extending from the bubble-shaped device for sealing to the patch material 22. An interior 26 of the device 20 can be filled with fluid (e.g., air or liquid), or a spongy or like shape-memory material. The patch of material 22 can be pre-formed and disposed along any portion of a package 10 to provide the restrictive valve functionality described herein.

In the application of valve closures 20 that include an air pressurized bubble, or other closure valve types such as rubber, that have both forgiveness, flexibility and shape memory (causing them to spring back toward the original shape after squeezing of the package), the sealing and placement system of the present invention is desired. This sealing method allows the panel 14 (or 12) opposing the valve closure 20 to press down against the valve, pinching off any opportunity for the product, or air, to pass by it until selective dispensing is performed.

Further, with some valves types 20, it is not desirable to actually seal the opposing panel of material into or onto the valve 20 itself, especially if the valve is a more solid material without much, or any, memory or forgiveness. In such applications, the flexible material of the package is relied on to flex away from the valve material 20 to allow the air or liquid to pass by the valve material 20 when the package 10 is squeezed or otherwise receiving adequate pressure.

With a valve 20 filled with fluid or gas (e.g., air), such as a generally convex-shaped bubble, there can be problems with sealing the structure to the package. One problem is the bubble is made with a particular amount of pressure in it. This pressure is typically the minimum required in order to drape the opposing panel of the package over it and allow highly viscous materials, such as shampoos or other like liquids, to pass by it when the package is squeezed. That same amount of pressure in the bubble, if not pressurized more, may allow less viscous materials such as water to leak past it when it isn't so desired. In addition, if, when sealing the opposing panel (or film/panel 60) over the bubble, the heat from creating the seal is on or along a large enough portion of the bubble, the bubble material can actually separate, allowing the air or gas out of the bubble—thus rendering it essentially less effective or even useless. This makes it very difficult to pressurize the bubble more, especially when that is desired for the less viscous liquids. For these reasons, a special designed seal configuration is necessary to make the valves work as intended. The present invention solves each of these problems.

Figure 5:
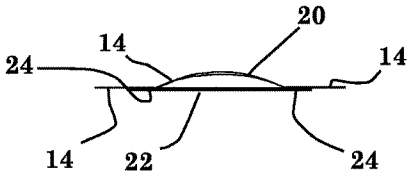
FIGS. 5-7 show a bubble valve/closure device having bracket seals aligned with the outer edges of the bubble, in accordance with embodiments of the present invention.
Figure 6:
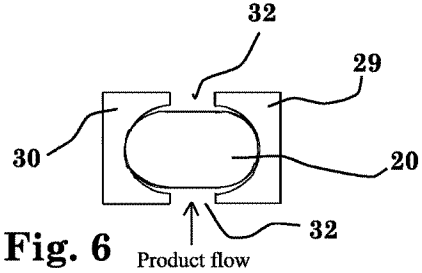
Figure 7:
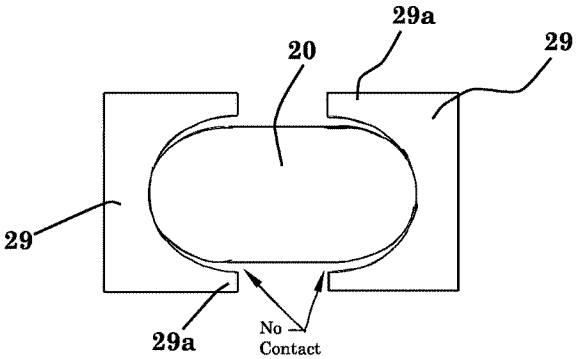

Referring to the embodiments of FIGS. 3-11, bracket seal devices 29 or other seals that can overlay on the ends of the bubble 20 or run outside the bubble area from the ends toward the center of the bubble width, on each end of the bubble, are provided (FIGS. 5-7). As shown in FIGS. 5-7, the brackets and respective seals are aligned with the outer edges of the closure 20 (e.g., slightly engaging or contacting the outer edges). A pathway 32 is thereby defined for eventual passage of the package contents upon squeezing of a portion of the package by the user. As such, the opposing panel of film 14 (or film 60) can be draped over the bubble, much like pulling down all four corners of a sheet on a mattress to pull out the wrinkles (e.g., FIG. 5). Portions of the draped panel 14 can be sealed to the ends 24 of the closure 20. The opposing panel 14 is therefore completely formed over the bubble, leaving no air gaps. This will, when required for more viscous materials, not overly pressurize any air or gas in the bubble 20, allowing for desirable or even minimal force to squeeze the product past the bubble 20. When squeezing, the bubble 20 will flex inward and the opposing panel 14 will flex away from the bubble 20, as the material passes through. Once the user stops squeezing, the bubble closure 20 and the opposing panel 14 (or 60) will flex back to each other, seating together—not allowing the liquid or air to pass by until the user again sufficiently squeezes the package.

The brackets 30 can include inward extending portions 29*a*. By only running the brackets 29 onto the ends of the bubble 20, and toward the centerline of the bubble 20, but off or free of contact with the bubble 20 in that portion 29*a* (defining pathway 32), the bubble pressure can be finely adjusted—e.g., provided higher for less viscous materials, while not creating too much damaging heat on the actual bubble seal.

Figure 8:
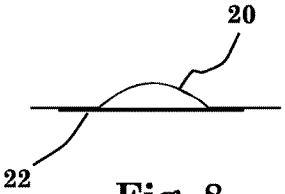
FIGS. 8-9 show a bubble valve/closure device having bracket seals overlapping the outer edges of the bubble to increase pressurization, in accordance with embodiments of the present invention.
Figure 9:
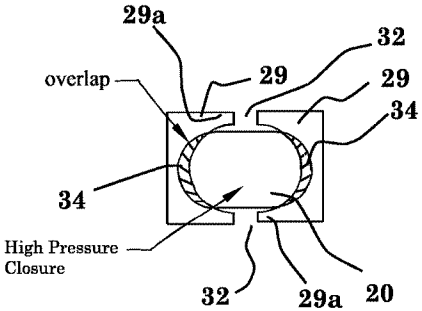

As shown in FIGS. 8-9, the brackets 29 can overlap the outer edges 34 of the bubble 20 (sealed area 34 shown with hash marks) to provide a bubble closure 20 with increased pressure or tension of the opposing film 14 (or 60) over the bubble valve 20. FIG. 8 depicts such a closure 20 with increased pressure applied, thereby increasing the expanded profile of the closure 20.

Figure 11:
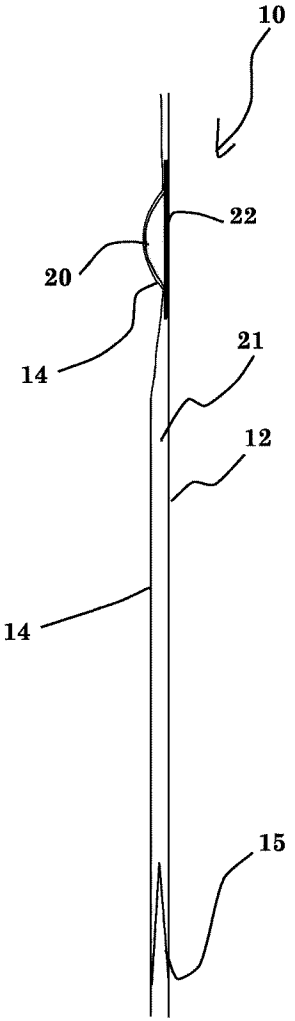
FIGS. 10-11 show a package having a bubble valve/closure device, in accordance with embodiments of the present invention.
Figure 10:
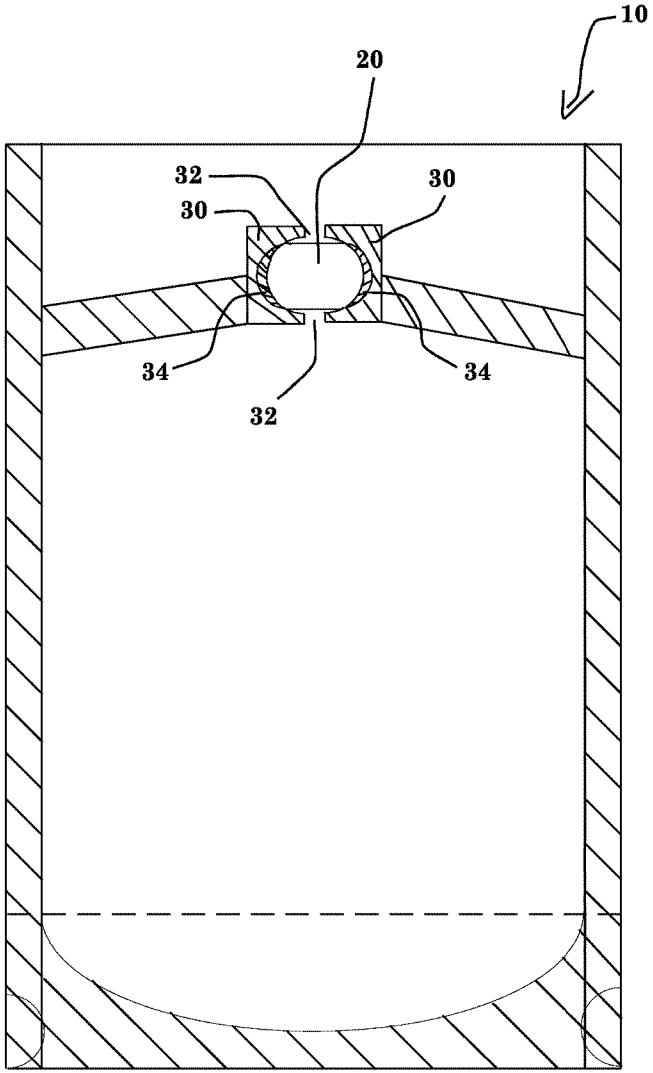

FIGS. 10-11 show the applied device 20, including the sealed portions 30 created by the bracket seal device 29 on the package 10 (FIG. 10).

In certain embodiments, the ends or portions 30*a* of the bracket seals 30 can run toward the centerline of the bubble 20 approximately ⅓ the width of the bubble 20, leaving ⅓ in the center of the bubble 20 for the product to flow past the bubble 20, along pathway 32, when the package 10 is squeezed.

This method and packaging system works well with a rigid or semi rigid piece of closure material 50 affixed to a panel (e.g., panel 12) of the package 10 as well, as shown in FIGS. 12-15. When the opposing panel 14 (or 60) is sealed around the closure valve piece 50 with bracket seals 30, but not onto the rigid piece of material, it acts as a valve and will not let liquids or other package content pass by it without a certain amount of applied pressure. By sealing the opposing panel 14 around both ends of the object 20 as depicted with seal portion S, but leaving a pathway 32 across its approximate center, the tension created around the rigid materials perimeter is such that it will not allow air or liquid to pass by. Moreover, the fluid or flow path will occur at its approximate centerline when a user squeezes the package and causes the opposing panel 14 to flex away from the valve closure material 50. The rigid or semi-rigid valve piece can be of multiple shapes and sizes, as long as the bracket seals 30 follow just outside its contour or perimeter and seal the front and back panels 12, 14 together in those areas—e.g., leaving a small gap 32 in the center for the product or fluid to flow past when the package 10 is squeezed. It is desirable, when the valve piece construct allows, to seal the outer ends or portions of the material of the opposing panel to it as with the aforementioned bubble material.

In certain embodiments, the valve closure device 50 can be tapered or flared around all or a portion of its perimeter surfaces, such that the bracket seals can seal a portion of the perimeter between the opposing panel 14 (or film 60) to further seal off any opportunity for the product to leak around the perimeter of the device 50. Further, not every surface, edge, or portion of the device 50 needs to be sealed to material in various embodiments.

While it may be desirable, it is not necessary with certain embodiments to have the valve device 50 affixed to one of the panels. As such, if it is not sealed or attached to either panel, but is merely trapped between the opposing panels 12, 14 with the bracket seals 30, the air or liquid will still be blocked until pressure is applied to the package. In this case, the air or liquid could pass on either side of the valve piece.

One embodiment of the process steps for making or forming the package 10 with the valve brackets includes applying the valve closure 20, 50 (e.g., bubble material, foam like piece, rigid or semi rigid material, or any structure that has a shape and a thickness to it) so that it is affixed to one of the panels of the package 10 (e.g., panel 12). This can be done by heat, adhesive, or other processes known to those skilled in the art. Once the valve piece is affixed to one panel, the opposing panel (e.g., panel 14) is placed over, or onto, the panel with the valve piece and the bracket seals 30 applied by heat bonding or other methods known to one skilled in the art. If using an air bubble 20 as the valve device, where the amount of pressure required for different viscosities of products can be altered, the bracket seals 30 can be adjusted in and out on each end of the closure 20 to increase or decrease the level of pressure in the bubble—as detailed herein. This will correspondingly adjust the ease or difficulty of the product within the package to traverse past the valve closure 20, 50 when the package is squeezed. These processes can take place during or prior to running on a pre-made pouch machine, any type of form, fill, and seal machine, or other packaging line machines and processes known to those skilled in the art.

Once the bracket seals 30 are in place, the material can go through the remainder of the pouch or packaging machine to form the remainder of the pouch. The pouch can have multiple panels, gussets, handles, shapes, or any other feature found on any other packages so long as they don't interfere with the function of the valve.

Figure 17:
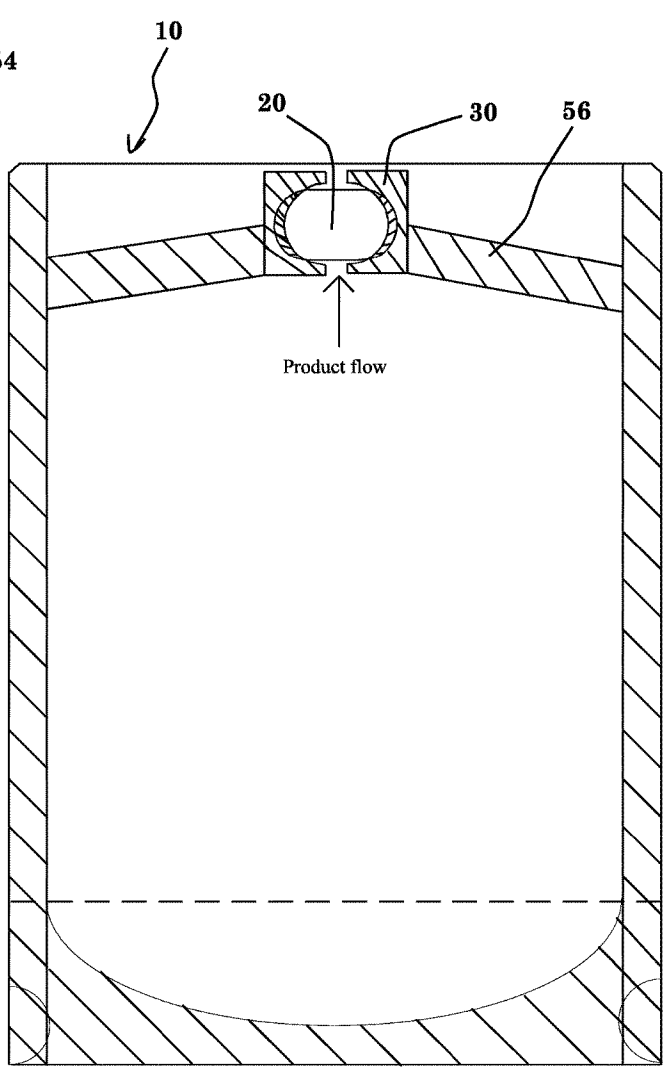
FIGS. 16-17 show a package having a bubble valve/closure device, and tear portions, in accordance with embodiments of the present invention.
Figure 16:
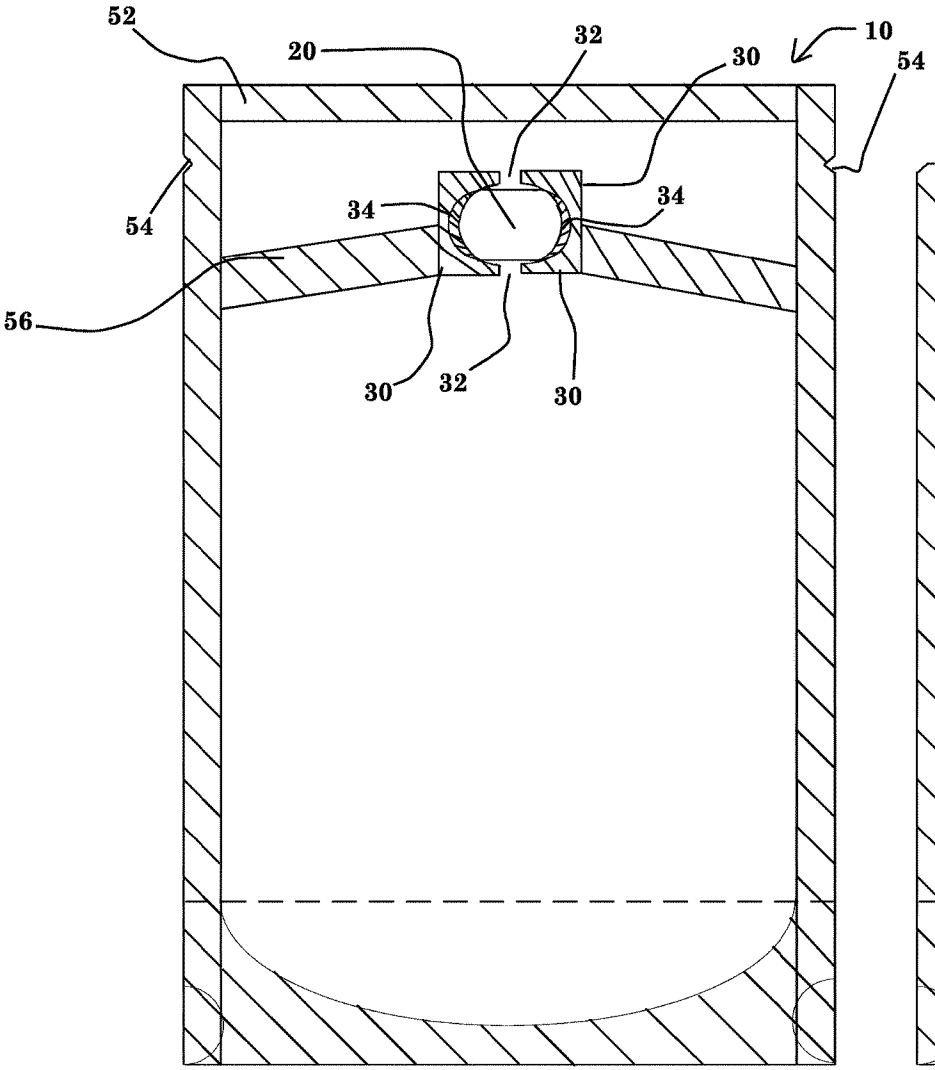

As shown in FIGS. 16-17, the package can be filled with product and sealed closed (e.g., at a top seal portion 52). A slit, tear notch, or like opening feature 54 can be provided to facilitate opening up of the top portion 52 (e.g., in side seal of FIG. 16). While the valve closure devices have been shown proximate a central top portion of the package in certain embodiments, the devices 20, 50, and methods described herein, can be provided to and anywhere on the package, including a narrowing throat or funnel portion of the package, the side of the package, the bottom of the package, extending out from the panels 12, 14, and the like. Other seals or sealed package portions 56 can be included on or around the devices 20, 50, or the corresponding bracket seals 30.

Figure 21:
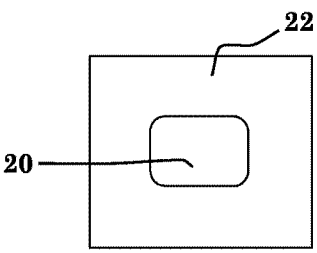
FIGS. 19-21 show various shaped and sized valve/closure devices, in accordance with embodiments of the present invention.
Figure 20:
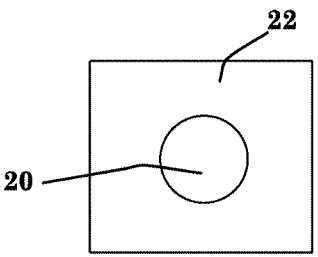
Figure 19:
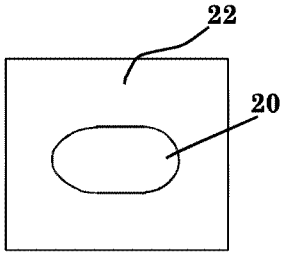
Figure 23:
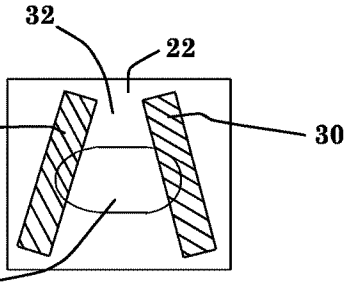
FIGS. 22-27 show various bracket seal configurations and constructs for valve/closure devices, in accordance with embodiments of the present invention.
Figure 22:
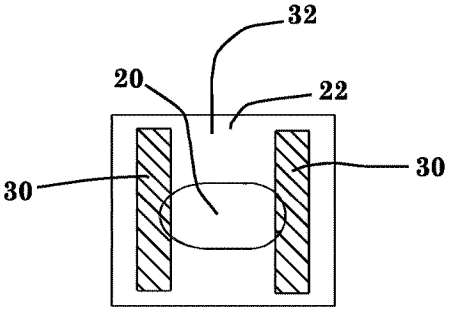
Figure 27:
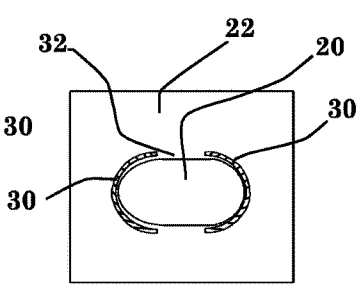
Figure 26:
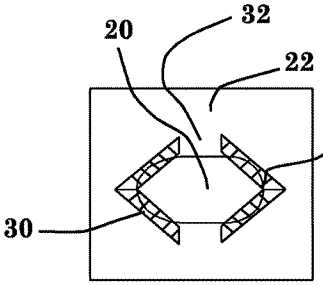
Figure 25:
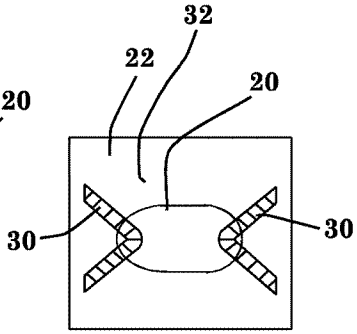
Figure 24:
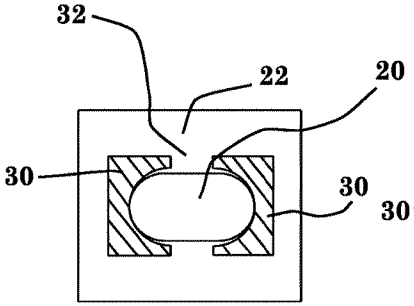

Referring to FIGS. 19-21, valve devices (20 or 50) constructed in various shapes and sizes are provided, including oval or oblong, circular, and rectangular. Other shapes and sizes are envisioned for use as well without deviating from the spirit and scope of the present invention. The valve devices can be attached to and delivered with or without a patch.

FIGS. 22-27 depict embodiments of the present invention with varying bracket seal 30 configurations. The seals 30 can be applied, around or on portions of the devices 20, longitudinally (FIG. 22), angled (FIG. 23), peripherally with inward facing seal portions (FIG. 24), V-shaped (FIGS. 25-26), C-shaped (FIG. 27), and in a myriad of other configurations, shapes, and constructs. One or more fluid or flow pathways 32 are defined between the bracket seals 30 of the various embodiments, as detailed herein.

Figure 29:
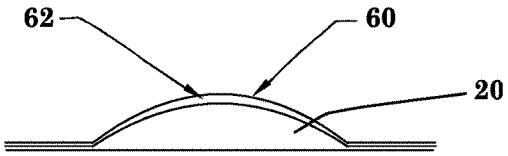
FIGS. 28-31 show valve/closure devices interfacing with a separate film or material layer rather than the package panel, in accordance with embodiments of the present invention.
Figure 28:
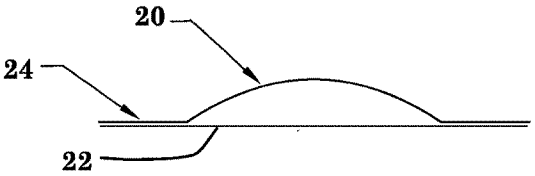
Figure 30:
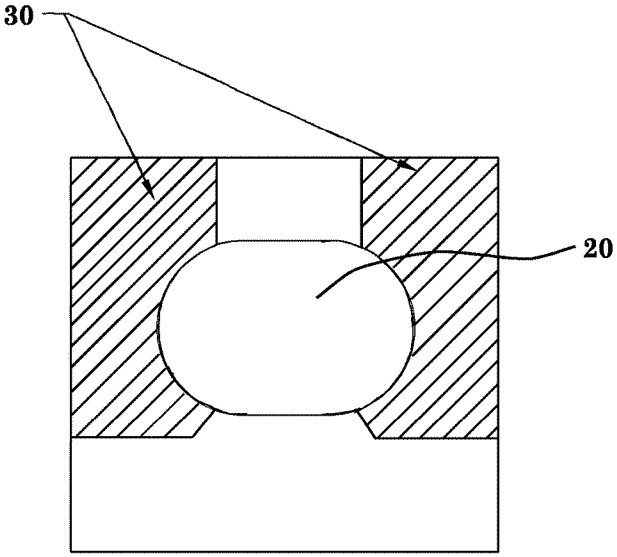
Figure 31:
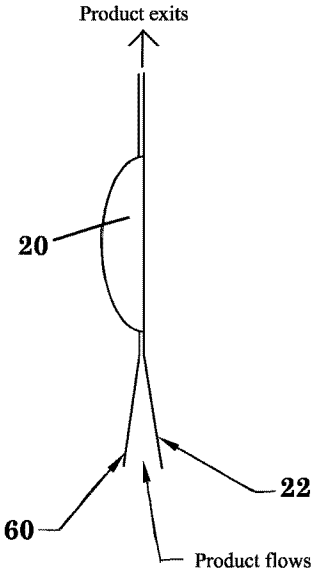

Referring to FIGS. 28-31, the valve device (20 or 50) can be draped with a separate film or material layer 60, rather than having the opposing panel (12, 14) laying over the top of the valve as disclosed in other embodiments. Rather than fluid passing between the valve 20 and the panel portion (12, 14) as with other embodiments, a fluid pathway 62 from the inner cavity 21 out past the device 20 is defined between the device 20 and the outer material layer 60 (FIG. 29). As a result, the valve 20 can be attached to one or more of the panels (e.g., 12) of the package 10 without having an opposing panel (e.g., 14) interfacing or draping with the valve 20. Instead, the film 60 interfaces with and thereby permits attachment or application of the valve 20 at any portion or panel of the package 100. Further, the various layers 22, 24, 60 can be sealed to a single panel or the opposing panel of the package 100. FIG. 31 demonstrates an embodiment where the film layer 60 and layer 22 are adapted for attachment to panel portions of the package—again, the same or opposing panels.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive packages. Further, features and aspects of the various embodiments described herein can be combined to form additional embodiments within the scope of the invention even if such combination is not specifically described herein.

References to front, back and side panels for the package and package formation embodiments described herein are provided to facilitate an understanding of orientation and direction and are not intended to be limiting. For instance, the valve devices, or other structures or portions of the package, can be provided to or along any portion of the package regardless of the references herein to front, back, side, bottom and the like.

What is claims is:

1. A package for holding and dispensing contents, comprising:

a first panel portion;

a second panel portion, wherein at least the first panel and the second panel define an internal cavity;

a content access portion including a protruding closure device having a device width, the content access portion having at least two opposed seal portions defining a flow pathway therebetween narrower than the device width such that the contents can be selectively forced through the flow pathway upon application of pressure to a portion of the package;

the at least two opposed seal portions including inward extending portions defining an inlet and an outlet to the flow pathway, the at least two opposed seal portions further defining an enlarged area of the flow pathway between the inlet and the outlet; and the protruding closure device being separated by a distance from the inward extending portions and being adjacent to the at least two opposed seal portions at a widest portion of the enlarged area.

2. The package of claim 1 wherein the enlarged area of the flow pathway is a generally elliptical shape with a minor axis aligned with the inlet and the outlet, and a major axis aligned with the widest portion of the enlarged area.

3. The package of claim 2 wherein the protruding closure device is adjacent to the at least two opposed seal portions along the major axis of the elliptical enlarged area.

4. The package of claim 1, wherein the protruding closure device contains a fluid.

5. The package of claim 4, wherein the fluid is a gas.

6. The package of claim 1, wherein the protruding closure device includes a material having a shape memory characteristic.

7. The package of claim 6, wherein the material is a rigid or semi-rigid material.

8. The package of claim 1, further including an interface material adapted to drape over at least a portion of the protruding closure device.

9. The package of claim 8, wherein the interface material is a portion of the second panel.

10. The package of claim 8, wherein the interface material is a film layer provided distinct from the first and second panels.

11. The package of claim 1, wherein the contents include a fluid.

* * * * *